US005911348A

United States Patent [19]

Shook

[11] Patent Number: 5,911,348

[45] Date of Patent: Jun. 15, 1999

[54] HARD SHELL NO-SWEAT BACKPACK

[76] Inventor: James M. Shook, 123 Sherland Ave., Mt. View, Calif. 94043

[21] Appl. No.: 08/921,858

[22] Filed: Sep. 2, 1997

[51] Int. Cl.[6] ..... A45F 3/04

[52] U.S. Cl. ..... 224/629; 224/153

[58] Field of Search ..... 224/629, 153, 224/634, 642, 644, 627, 628, 637, 209, 210, 211, 215; 2/421

[56] References Cited

U.S. PATENT DOCUMENTS

| | | | |
|---|---|---|---|
| 1,811,718 | 6/1931 | Hofbauer | 190/28 |
| 3,127,077 | 3/1964 | Faro | 224/629 |
| 3,902,640 | 9/1975 | Geiben . | |
| 3,960,300 | 6/1976 | Dickler . | |
| 4,088,252 | 5/1978 | Grunberger . | |
| 4,324,012 | 4/1982 | Cannaday | 224/644 |
| 4,903,350 | 2/1990 | Gentes et al. . | |
| 5,634,576 | 6/1997 | Arbel . | |
| 5,730,347 | 3/1998 | Finot | 224/628 |

FOREIGN PATENT DOCUMENTS

| | | | |
|---|---|---|---|
| 002662341 | 11/1991 | France | 224/213 |

*Primary Examiner*—Allan N. Shoap
*Assistant Examiner*—Maerena W. Brevard
*Attorney, Agent, or Firm*—Limbach & Limbach L.L.P.

[57] ABSTRACT

A backpack, to be carried on the back of a user, that includes a hollow shell and a lid. The hollow shell has a substantially rigid bottom wall, and a sidewall that extends up continuously from a periphery of the bottom wall and terminates in an annular upper edge. The annular upper edge defines an opening into the interior of the hollow shell. The sidewall has a leading end and a trailing end and is also substantially rigid. A lid is rotatably connected to the shell. The lid is rotatable between an open position for exposing the opening and a closed position for covering the opening. A pair of shoulder straps are connected to the shell for supporting the backpack on the back of the user so that the bottom wall faces the user's back. A plurality of pads are affixed to an outside surface of the bottom wall. During use, the plurality of pads support the bottom wall in spaced relation to the user's back thus maintaining a ventilation gap between the bottom wall and the user's back. The sidewall and the lid together form a backpack upper surface that has a streamlined aerodynamic shape, such that when air flows past the leading end, some of the air is directed through the ventilation gap formed between the bottom wall and the user's back, and some of the air is directed along the upper surface with minimal wind resistance.

22 Claims, 6 Drawing Sheets

HARD SHELL NO-SWEAT BACKPACK

FIELD OF THE INVENTION

The present invention relates to backpacks, and more particularly to backpacks used in "motion" sports such as bicycle riding, motorcycle riding, roller skating, downhill skiing, horseback riding, jogging and walking.

BACKGROUND OF THE INVENTION

Currently, most backpacks ideal for motion sports are made of soft materials such as nylon, canvas, or leather. These packs have two shoulder straps and are supported to lay flat against the user's back during use. Soft material backpacks have an overall shape that is mainly dictated by the amount, shape and location of items stored therein. Such packs usually have a zipper top for opening and accessing the inside of the pack.

Prior art backpacks have several drawbacks for motion sports users, who often lean forward while wearing the backpack. For example, bicyclists and motorcyclists are "hunched" over handlebars. In this position, a pack worn on the rider's back is directly exposed to the air flowing past the rider. Further, soft material backpacks collapse around the contents therein, leaving the pack with a shape that can exhibit high wind drag and induces increased turbulence at high speeds. Further, contents inside the pack can be easily damaged when the pack is bumped into hard objects or is dropped. Moreover, sharp or irregularly shaped items contained inside the pack can protrude through or deform the pack and irritate back of the user.

Many users do not like the feel of a pack that lays flat across their back. When exercising vigorously or in hot weather, a large sweat spot forms on the user where the pack rests on the user's back. Typically, prior art backpacks lay flat against and cover most the user's back, without providing a way to cool the user's back or a way for sweat from the user's back to evaporate. In some packs, the user's sweat is absorbed by the pack's material, and transferred to the contents contained inside the pack.

Prior art packs further tend to provide insufficient weatherproofing. Even treated soft materials fail to provide long term weatherproof performance, thus allowing rainwater, sweat and dirt to contaminate the inside of the pack and the contents therein. Further, condensation from cold items placed in the pack are felt on the user's back. Lastly, prior art packs do not provide security for the pack and/or the contents therein.

There is a need for a backpack that minimizes wind resistance, protects the contents therein from external shock, prevents irregularly shaped items therein from irritating the user's back, reduces or eliminates the sweat spots that form on the user's back, provides superior weatherproofing and insulating performance, and provides security for the pack and/or contents therein, all while being comfortable for the user to wear.

SUMMARY OF THE INVENTION

The present invention solves the aforementioned problems by providing a rigid aerodynamic shaped backpack that provides airflow between the rider's back and the pack during use, with minimal wind resistance.

More specifically, the backpack of the present invention is designed to be carried on the back of a user, and includes a hollow shell and a lid. The hollow shell has a substantially rigid bottom wall, and a sidewall that extends up continuously from a periphery of the bottom wall and terminates in a rounded upper edge. The rounded upper edge defines an opening into the interior of the hollow shell. The sidewall has a leading end and a trailing end and is substantially rigid. A lid is movable between an open position for exposing the opening and a closed position for covering the opening. A pair of shoulder straps are connected to the shell for supporting the backpack on the back of the user so that the bottom wall faces the user's back. A plurality of pads are affixed to an outside surface of the bottom wall. During use, the plurality of pads support the bottom wall in spaced relation to the user's back thus maintaining a ventilation gap between the bottom wall and the user's back. When air flows past the leading end, some of the air is directed through the ventilation gap formed between the bottom wall and the user's back.

A further feature of the present invention is that the sidewall and the lid together form a backpack upper surface that has a streamlined aerodynamic shape when the lid is in the closed position. When air flows past the leading end, some of the air is directed through the ventilation gap formed between the bottom wall and the user's back, and some of air is directed along the upper surface.

Other objects and features of the present invention will become apparent by a review of the specification, claims and appended figures.

DETAILED DESCRIPTION OF THE PREFERRED EMBODIMENTS

The present invention is an aerodynamic, streamlined shaped, rigid backpack that exhibits superior wind drag performance while directing airflow between the user's back and the backpack. The backpack is ideal for all motion sport users, especially bicycle riders as described below.

Figure 1A:
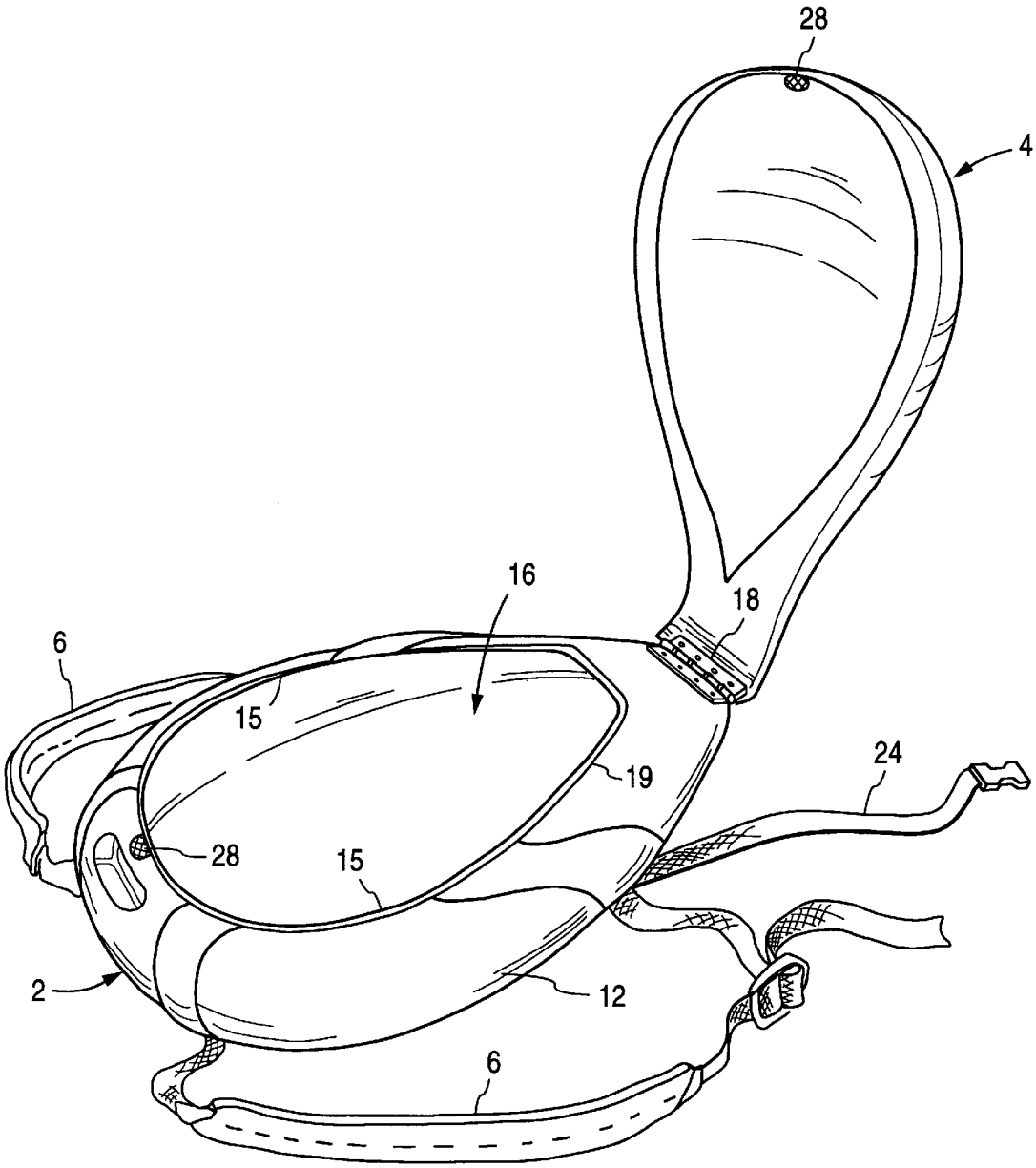
FIG. 1A is a perspective view of the backpack of the present invention.
Figure 1B:
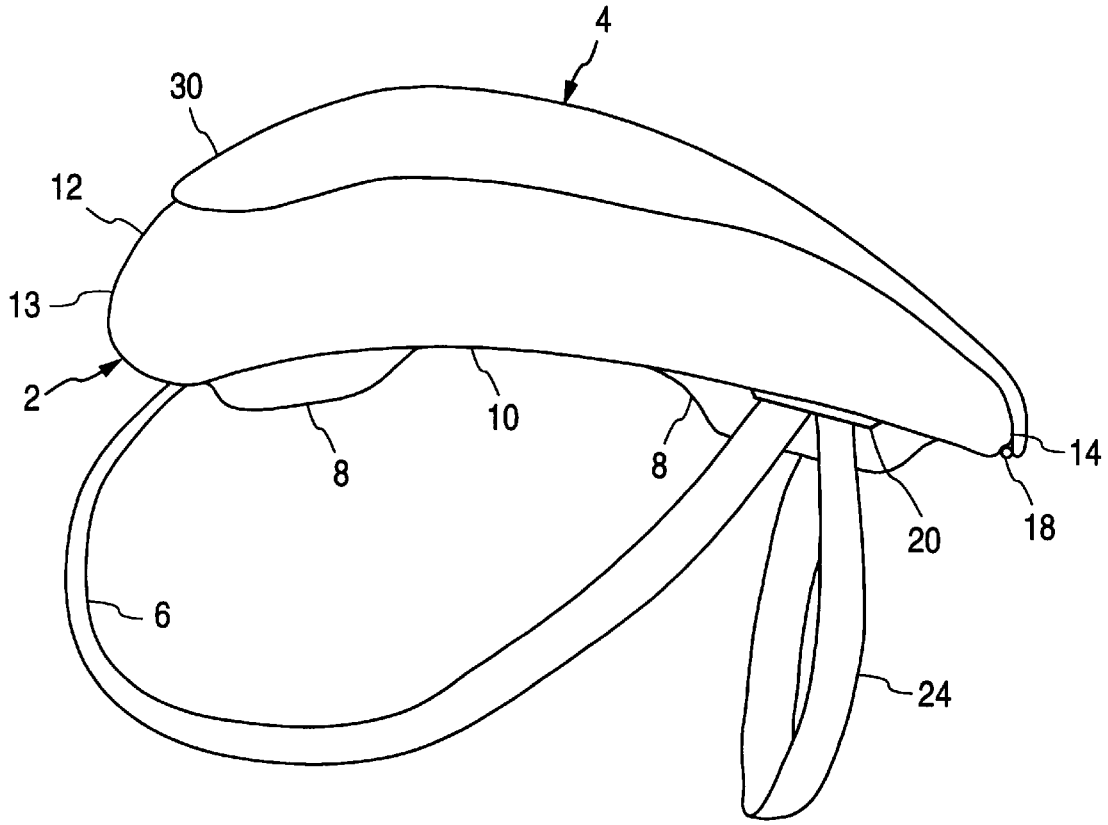
FIG. 1B is a side view of the backpack of the present invention.
Figure 1C:
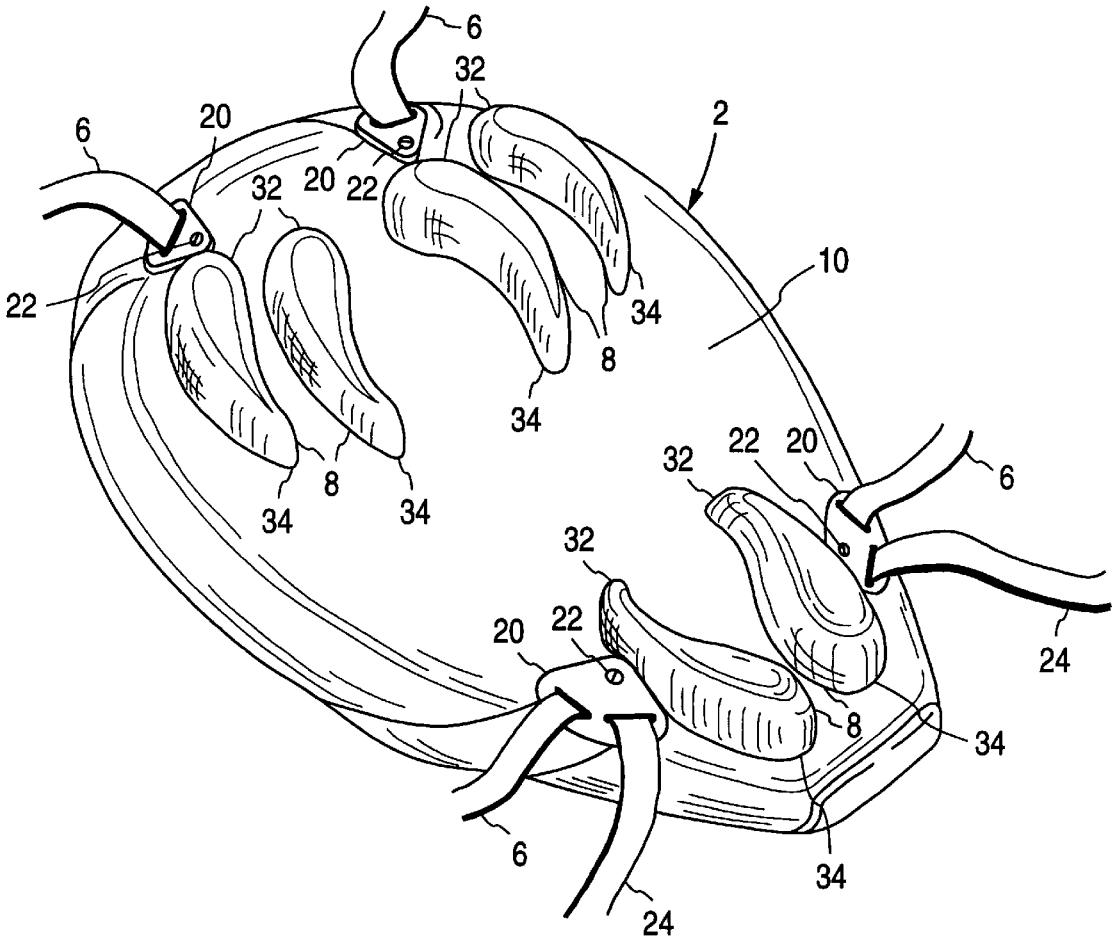
FIG. 1C is a bottom view of the backpack of the present invention.

The backpack 1 of the present invention is illustrated in FIGS. 1A–1C, and includes a rigid hollow shell 2, a lid 4, shoulder straps 6 and pads 8.

The shell 2 includes a bottom wall 10 and a rounded sidewall 12 which has a leading end 13 and a trailing end 14. The rounded sidewall 12 extends up from the bottom wall 10 and terminates with an upper edge 15 that defines an opening 16. The bottom wall 10 has a slight concave shape in the direction between the leading and trailing ends 13/14 that closely matches the curve of a bicycle rider's back when the rider is bent over the handlebars. The shell 2 is ideally made of a rigid material, such as vacuum formed ABA plastic, resin impregnated carbon fiber, injected molded plastic or a wire support frame covered with a fabric.

The lid 4 is rotatably attached to the trailing end 14 of the sidewall 12 by a hinge 18. The lid 4 is also ideally made of one of the rigid materials listed above for the shell 2. When rotated into a closed position, lid 4 covers and seals opening 16. In the preferred embodiment, a rounded rubber gasket or seal member 19 between lid 4 and shell 2 is provided to prevent dirt, rainwater, etc from entering the interior of the hollow shell 2.

Shoulder straps 6 are attached to the bottom wall 10 by eyelets 20, which are secured to the bottom wall 10 by bolts or rivets 22. Ideally, eyelets 20 freely rotate about bolts/rivets 22 to facilitate looping the shoulder straps 6 around the user's shoulders and to provide a comfortable fit. A waist strap 24 is attached to the bottom two eyelets 20 and loops around the user's waist.

Aerodynamically shaped pads 8 are attached to the outside surface of the bottom wall 10 such that when the backpack is worn by the user, the pads 8 support the bottom wall 10 away from (in spaced relation to) the user's back to form and maintain a ventilation air gap therebetween. The shape, number and position of the pads 8 are selected to maximize air flow between the bottom wall 10 and the user, to support the backpack 1 comfortably on the user's back, to minimize the swing of the backpack 1 while in use, and to minimize any sweat spots that may form on the user's back where the pads 8 contact the user. More specifically, the pads 8 ideally have an elongated, teardrop-like shape, with rounded leading and trailing ends 32/34 to enhance air flow. Each pad 8 has one end that is wider than the other to provide varying support along the length the pad 8. The pads 8 illustrated in FIG. 1C have their wider ends oriented to face either the leading end 13 or the trailing end 14, whichever is closer to the pad. This orientation is preferred to distribute weight judiciously and proportionally. The number of pads 8 are selected to provide the desired support of the backpack 1 on the user back depending upon the weight distribution of the backpack and any contents held therein. The positions of the pads 8 are ideally selected to support the backpack 1 around the shoulder blades and the lower back of the user, and away from areas that could be aggravated during use such as the spine and tailbone.

In the preferred embodiment, there are four elongated pads 8 located on the bottom wall 10 near the leading end 13, which are located to engage the user's back near the shoulder blades. Two additional pads 8 are located on the bottom wall 10 near the trailing end 14 to engage the user's lower back near the lumbar/hip area. These pad locations are ideal because the backpack rests comfortably on the user's back via the pads 8 not only when the user's back is curved while bicycle riding, but also when the user's back is substantially straight while standing up. The pads 8 are affixed to the bottom wall with hook and fabric connectors 25 (sold under the trademark VELCRO), so that the user can change the number and positions of the pads for a custom fit and even weight distribution. Other semi-permanent methods of attaching the pads 8 to the bottom wall 10 that facilitates pad repositioning are double stick tape, or adhesive bonding agents.

Figure 2A:
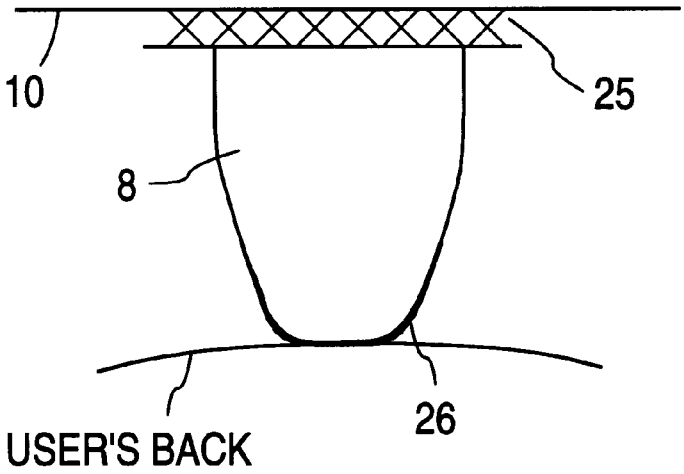
FIG. 2A is a cross-sectional view of an un-compressed pad.
Figure 2B:
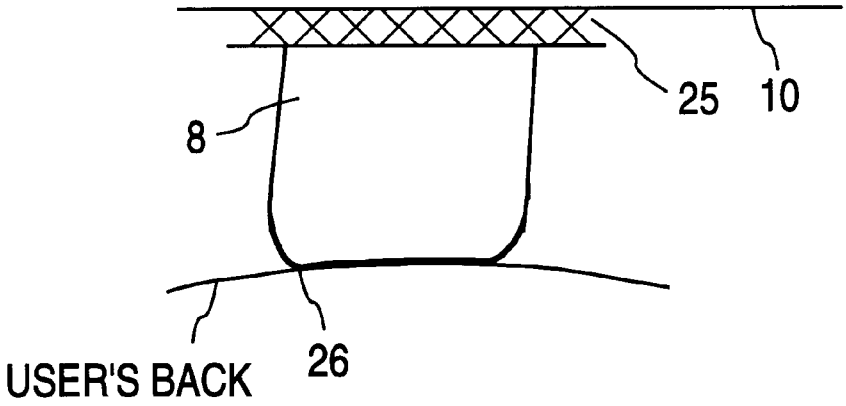
FIG. 2B is a cross-sectional view of a compressed pad.

The pads 8 are designed to provide varying degrees of support on the user's back depending upon the weight of the contents placed in backpack 1, as illustrated in FIGS. 2A–2B. Pads 8 are made of a flexible material, such as foam rubber or foam neoprene. Each pad 8 has a tapered surface 26 that actually contacts the user's back. As the pad compresses, the area of surface 26 that contacts the user's back increases thus providing additional support for backpack 1. Thus, when the backpack 1 is empty or contains lightweight contents therein, the pads 8 require minimal surface contact with the user's back to keep the backpack comfortably in place during use (see FIG. 2A). However, as the weight of the contents in the backpack increases, additional support is required to support the weight and to prevent the rigid backpack 1 from rocking or swinging on the user's back. This additional support is provided automatically by the pads 8, which compress under the additional weight of the backpack 1 thus increasing the total surface area of the pads that contact the user's back, as illustrated in FIG. 2B. For comfort, it is desirous that the pad surface contact with the user be minimized. With the shaped pads 8 of the present invention, only the necessary surface contact between the pads and the user results, depending upon the weight of the backpack 1.

Figure 3A:
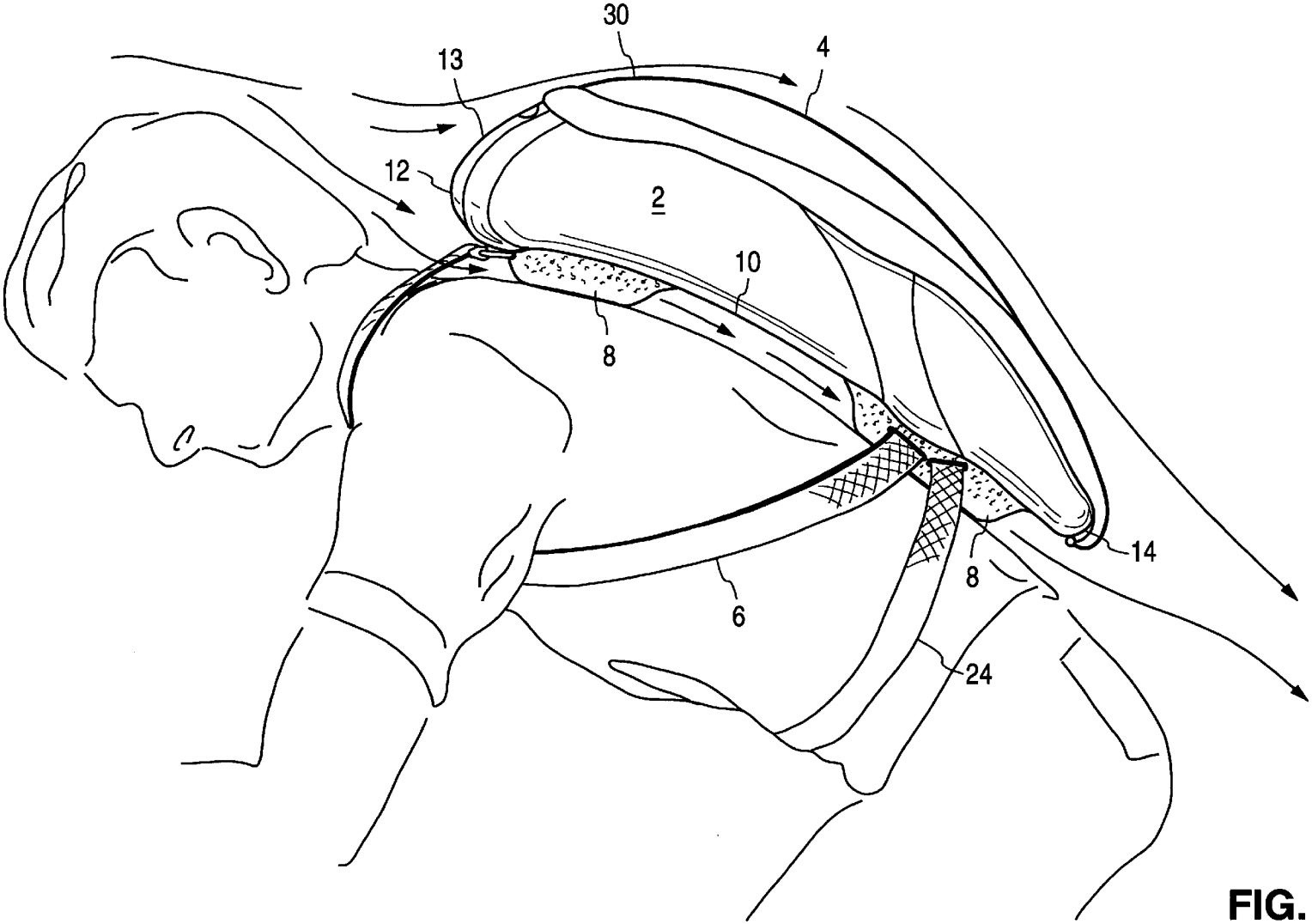
FIG. 3A is a side view of the backpack worn by a user illustrating the flow of air over the backpack of the present invention.
Figure 3B:
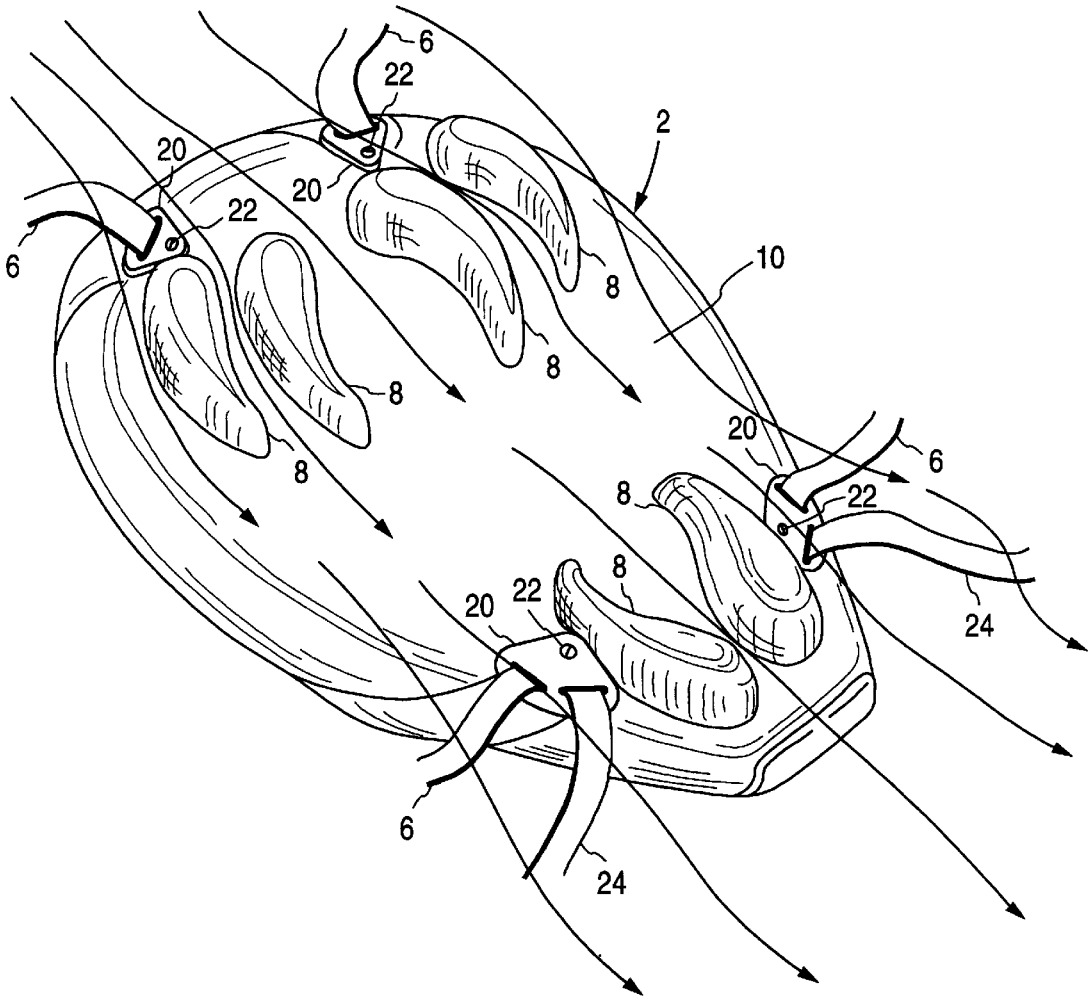
FIG. 3B is a bottom view of the backpack illustrating the flow of air over the backpack and past the pads of the present invention.

The shell 2 and lid 4 form a backpack upper surface 30 that, together with the bottom wall 10, results in an overall aerodynamic streamlined backpack shape that reduces wind drag while directing air flow between bottom wall 10 and the user's back, as illustrated in FIGS. 3A-3B. The upper surface 30 is formed by sidewall 12 and lid 4, which together have an overall teardrop shape. The teardrop shape is formed by the rounded shape of sidewall 12 and lid 4 at the leading end 13, which taper down toward the trailing end 14. The combination of the teardrop shaped upper surface 30 and the slightly concave bottom wall 10 results in minimal wind drag yet maximum cooling effect from air flowing along bottom wall 10. By minimizing wind drag, the energy needed to propel a cycle rider through the air is minimized, and turbulence at high speeds is reduced. Ideally, the outer edge of lid 4 closely overlaps part of the sidewall 12 near upper edge 15 to maintain the smoothness, and thus the aerodynamic shape, of upper surface 30.

The rigid shell 2 and lid 4 protect contents placed therein when the backpack 1 has heavy objects on it, is dropped or is bumped by other rigid objects. The rigidity of backpack 1 also protects the user's back from any sharp objects contained therein that would otherwise rub or aggravate the user's back. Further, the solid shell/lid combination protects the user from any condensation from cold items placed inside the backpack 1, while providing a weatherproof enclosure for these items. Lastly, the rigidity of shell 2 ensures that the shell contacts the user only by pads 8.

A latch 28 is used to hold the lid 4 in its closed position. The latch 28 of the preferred embodiment is a hook and fabric (trademark Velcro) connector. However, a key or combination lock can be used as a latch 28 to keep the lid 4 closed and/or lock backpack 1, with the aid of a cable (not shown), to a stationary object.

Figure 4:
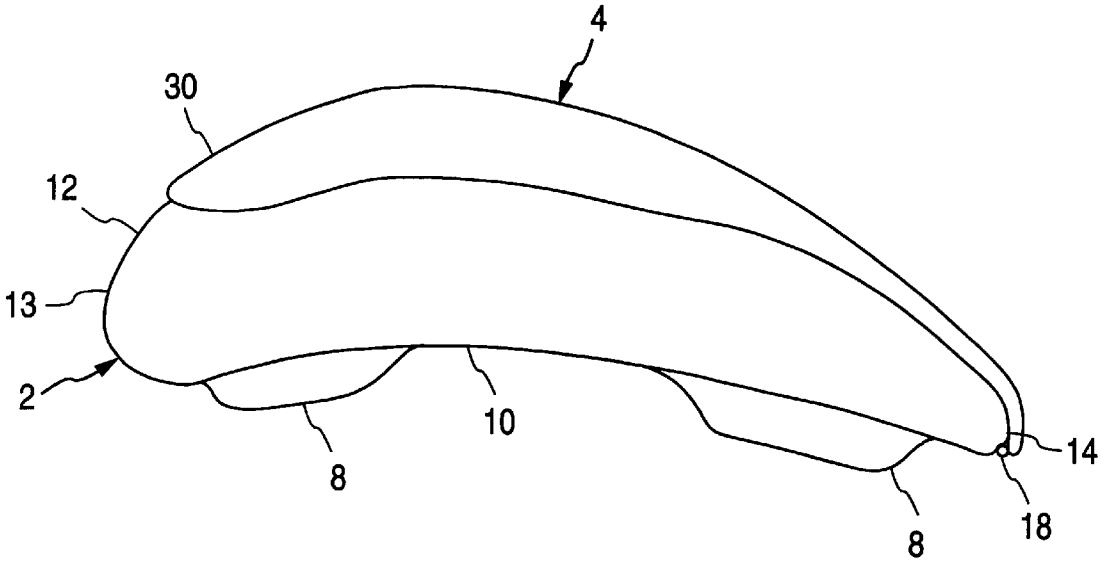
FIG. 4 is a side view of an alternate embodiment of the backpack of the present invention.

It is to be understood that the present invention is not limited to the embodiments described above and illustrated herein, but encompasses any and all variations falling within the scope of the appended claims. More specifically, while the teardrop shaped upper surface 30 and concave bottom wall 10 illustrated for the preferred embodiment provides excellent aerodynamic and cooling performance, it is well within the scope of the present invention to provide a backpack shell 2 and lid 4 having other aerodynamic shapes that exhibit low wind drag while directing air flow between the backpack's bottom wall 10 and the user's back. For example, FIG. 4 illustrates bottom wall 10 being flat. Pads 8 are positioned and sized to comfortably support the flat bottom wall 10 away from the curved back of the user during use. Further, other streamlined shapes of surface 30, which exhibit equivalent aerodynamic and cooling performance to the teardrop shape, can be used for the backpack 1 of the present invention. While backpack 1 has been described above in conjunction with bicycle riders, the present invention is ideal for any motion sport user.

What is claimed is:

1. A backpack to be carried on the back of a user, comprising:

a hollow shell that includes:

a substantially rigid bottom wall, and a sidewall extending up continuously from a periphery of the bottom wall and terminating in a rounded upper edge thereof that defines an opening into the interior of the hollow shell, wherein the sidewall has a leading end and a trailing end and is substantially rigid;

a lid that is movable between an open position for exposing the opening and a closed position for covering the opening;

a pair of shoulder straps connected to the shell for supporting the backpack on the back of the user so that the bottom wall faces the user's back;

a plurality of pads affixed to an outside surface of the bottom wall, wherein during use the plurality of pads support the bottom wall in spaced relation to the user's back thus maintaining a ventilation gap between the bottom wall and the user's back, and wherein the sidewall and the lid together form a backpack having a teardrop shaped upper surface that has a streamlined aerodynamic shape when the lid is in the closed position for minimal air resistance such that when air flows past the leading end, some of the air is directed through the ventilation gap formed between the bottom wall and the user's back, and some of the air is directed along the upper surface.

2. The backpack of claim 1, wherein the lid is substantially rigid and is rotatably connected to the shell such that the lid is rotatable between the open position and the closed position.

3. The backpack of claim 1, wherein each of the plurality of pads has an elongated shape with an aerodynamically rounded end facing the sidewall leading end and a length extending toward the sidewall trailing end to maximize air flow through the ventilation gap.

4. The backpack of claim 3, wherein each of the pads have a width that varies over the length thereof.

5. The backpack of claim 4, wherein each of the pads has a wide end that is wider than a narrower opposing end, and wherein each of the pads is oriented so that its narrower opposing end faces a central portion of the bottom wall.

6. The backpack of claim 4, wherein the plurality of pads are removably mounted to the outside surface of the bottom wall.

7. The backpack of claim 1, wherein each of the plurality of pads is made of a compressible material and has a tapered contact surface for contacting the user's back, and wherein the portion of the tapered contact surface that contacts the user's back increases as the pads are compressed.

8. The backpack of claim 1, further comprising:

a waist encircling strap connected to the shell.

9. The backpack of claim 8, further comprising:

a plurality of eyelets each rotatably attached to the shell, wherein the shoulder straps and the waist encircling strap are affixed to the eyelets.

10. The backpack of claim 1, wherein the bottom wall has a concave shape in a direction oriented between the leading and trailing ends of the sidewall.

11. The backpack of claim 1, further comprising:

a rounded seal member affixed to one of the lid and the sidewall that forms a seal between the lid and the sidewall when the lid is in the closed position for sealing the opening.

12. A backpack to be carried on the back of a user, comprising:

a hollow shell that includes:

a substantially rigid bottom wall, and a sidewall extending up continuously from a periphery of the bottom wall and terminating in a rounded upper edge thereof that defines an opening into the interior of the hollow shell, wherein the sidewall has a leading end and a trailing end and is substantially rigid;

a lid that is movable between an open position for exposing the opening and a closed position for covering the opening;

a pair of shoulder straps connected to the shell for supporting the backpack on the back of the user so that the bottom wall faces the user's back; and a plurality of pads affixed to an outside surface of the bottom wall, wherein during use the plurality of pads support the bottom wall in spaced relation to the user's back thus maintaining a ventilation gap between the bottom wall and the user's back, and wherein the sidewall and the lid together form a backpack upper surface that has a streamlined aerodynamic shape when the lid is in the closed position such that when air flows past the leading end, some of the air is directed through the ventilation gap formed between the bottom wall and the user's back, and some of the air is directed along the upper surface;

wherein the upper surface is generally teardrop shaped, with a rounded front portion at the leading end that tapers down toward a rear portion at the trailing end in a streamlined fashion.

13. A backpack to be carried on the back of a user in motion wherein air flows over the user's back, comprising:

a hollow shell that includes:

a substantially rigid bottom wall, and a sidewall extending up continuously from a periphery of the bottom wall and terminating in an upper edge thereof that defines an opening into the interior of the hollow shell, wherein the sidewall has a rounded leading end and a trailing end and is substantially rigid;

a lid that is movable between an open position for exposing the opening and a closed position for covering the opening, wherein the sidewall and the lid together form a backpack upper surface;

a pair of shoulder straps connected to the shell for supporting the backpack on the back of the user so that the bottom wall faces the user's back and the leading end faces toward the user's head;

a plurality of pads affixed to an outside surface of the bottom wall, wherein during use the plurality of pads support the bottom wall in spaced relation to the user's back thus maintaining a ventilation gap between the bottom wall and the user's back, and the bottom wall and upper surface form a streamlined aerodynamic shape when the lid is in the closed position such that air flowing past the rounded leading end is partially directed through the ventilation gap and partially directed over the upper surface, both with minimal air resistance, wherein the upper surface is generally teardrop shaped, with a rounded front portion at the leading end that tapers down toward a rear portion at the trailing end in a streamlined fashion.

14. The backpack of claim 13, wherein each of the plurality of pads hag an elongated shape with an aerodynamically rounded end facing the sidewall leading end and a length extending toward the sidewall trailing end to minimize air flow resistance in the ventilation gap.

15. The backpack of claim 14, wherein each of the pads has a width that varies over the length thereof.

16. The backpack of claim 15, wherein each of the pads has a wide end that is wider than a narrower opposing end, and wherein each of the pads is oriented so that its narrower opposing end faces a central portion of the bottom wall.

17. The backpack of claim 16, wherein the plurality of pads are removably mounted to the outside surface of the bottom wall.

18. The backpack of claim 13, wherein each of the plurality of pads is made of a compressible material and has a tapered contact surface for contacting the user's back, and wherein the portion of the tapered contact surface that contacts the user's back increases as the pads are compressed.

19. The backpack of claim 13, wherein the bottom wall has a concave shape in a direction oriented between the leading and trailing ends of the sidewall.

20. A backpack to be carried on the back of a user in motion wherein air flows over the user's back, comprising:

a hollow shell that includes:

a substantially rigid bottom wall, and a sidewall extending up continuously from a periphery of the bottom wall and terminating in an upper edge thereof that defines an opening into the interior of the hollow shell, wherein the sidewall has a rounded leading end and a trailing end and is substantially rigid;

a substantially rigid lid that is movable between an open position for exposing the opening and a closed position for covering the opening, wherein the sidewall and the lid together form a backpack upper surface;

a pair of shoulder straps connected to the shell for supporting the backpack on the back of the user so that the bottom wall faces the user's back and the leading end faces toward the user's head; and wherein the upper surface generally forms a streamlined teardrop aerodynamic shape when the lid is in the closed position with a rounded front portion at the leading end that tapers down toward a rear portion at the trailing end in a streamlined fashion such that resistance and turbulence for air flowing over the user's back and over the upper surface is minimized.

21. The backpack of claim 20, wherein the bottom wall has a concave shape in a direction oriented between the leading and trailing ends of the sidewall.

22. The backpack of claim 20, further comprising:

a rounded seal member affixed to one of the lid and the sidewall that forms a seal between the lid and the sidewall when the lid is in the closed position for sealing the opening.

* * * * *

UNITED STATES PATENT AND TRADEMARK OFFICE

CERTIFICATE OF CORRECTION

PATENT NO.: 5,911,348
DATED: June 15, 1999
INVENTOR(S): James M. Shook

It is certified that an error appears in the above-identified patent and that said Letters Patent is hereby corrected as shown below:

In Col. 7, Line 6, replace "hag" with --has--

Signed and Sealed this

Ninth Day of November, 1999

*Attest:*

Q. TODD DICKINSON

*Attesting Officer*

*Acting Commissioner of Patents and Trademarks*